US011339597B2

(12) United States Patent
Mülhöfer et al.

(10) Patent No.: US 11,339,597 B2
(45) Date of Patent: May 24, 2022

(54) FLAP ASSEMBLY FOR A VEHICLE

(71) Applicant: STABILUS GMBH, Koblenz (DE)

(72) Inventors: Gerd Mülhöfer, Laubach (DE); Dirk Rennecke, Andernach (DE)

(73) Assignee: STABILUS GMBH, Koblenz (DE)

( * ) Notice: Subject to any disclaimer, the term of this patent is extended or adjusted under 35 U.S.C. 154(b) by 66 days.

(21) Appl. No.: 16/229,882

(22) Filed: Dec. 21, 2018

(65) Prior Publication Data

US 2019/0194996 A1 Jun. 27, 2019

(30) Foreign Application Priority Data

Dec. 22, 2017 (DE) ..... 10 2017 131 058.4

(51) Int. Cl.
*E05F 1/10* (2006.01)
*E05F 15/622* (2015.01)

(52) U.S. Cl.
CPC ..... *E05F 1/105* (2013.01); *E05F 1/1058* (2013.01); *E05F 15/622* (2015.01); *E05F 1/1091* (2013.01); *E05Y 2201/10* (2013.01); *E05Y 2201/426* (2013.01); *E05Y 2201/474* (2013.01); *E05Y 2800/236* (2013.01); *E05Y 2800/70* (2013.01); *E05Y 2900/50* (2013.01); *E05Y 2900/546* (2013.01)

(58) Field of Classification Search
CPC ..... E05F 1/1058; E05F 15/622; E05F 1/105; E05Y 2201/426
See application file for complete search history.

(56) References Cited

U.S. PATENT DOCUMENTS 6,588,526 B1 7/2003 Polz
6,953,220 B2 10/2005 Takehara
7,393,040 B2 * 7/2008 Guillez ..... F15B 15/1457 296/76
7,758,097 B2 7/2010 Dilley
9,222,296 B2 * 12/2015 Hamminga ..... E05F 15/41
9,976,332 B2 5/2018 Scheuring et al.
(Continued)

FOREIGN PATENT DOCUMENTS

CN 1351556 A 5/2002
CN 1607130 A 4/2005
(Continued)

OTHER PUBLICATIONS

European Search Report dated Apr. 9, 2019.

*Primary Examiner* — Gregory J Strimbu
(74) *Attorney, Agent, or Firm* — Lucas & Mercanti, LLP

(57) ABSTRACT

A flap assembly for a vehicle includes a flap, which by way of a linear actuator drive is pivotably drivable about a pivot axis from a closed position to an opened position. The drive includes a spring assembly that acts in a supporting manner on the flap. The actuator drive has an actuator housing that has one end articulated on the body of the vehicle, and an actuator rod being deployable from the other end of the housing. An external end of the actuator rod is articulated on the flap at a radial spacing from the pivot axis. The spring assembly is releasably disposed on the other end of the housing and has a compression spring supported by the actuator housing. The compression spring acts on the flap between a closed position and an initial opening angle of the flap.

12 Claims, 3 Drawing Sheets

(56) References Cited

U.S. PATENT DOCUMENTS

| | | | | |
|---|---|---|---|---|
| 2007/0261306 | A1* | 11/2007 | Hanna | E05F 15/622 49/52 |
| 2007/0289397 | A1* | 12/2007 | Ritter | E05F 15/622 74/22 A |
| 2007/0296244 | A1* | 12/2007 | Borrmann | E05F 15/622 296/146.8 |
| 2010/0186528 | A1* | 7/2010 | Hillen | F16D 7/048 74/89.23 |
| 2011/0068721 | A1* | 3/2011 | Bochen | E05F 15/622 318/379 |
| 2012/0000304 | A1 | 1/2012 | Hamminga | |
| 2012/0013143 | A1* | 1/2012 | Schiegel | E05F 15/40 296/146.4 |
| 2012/0137803 | A1* | 6/2012 | Bochen | F16H 25/2015 74/89.32 |
| 2015/0376929 | A1* | 12/2015 | Scheuring | F16D 41/064 74/89.38 |
| 2016/0069117 | A1* | 3/2016 | Leonard | F16H 25/20 16/400 |

FOREIGN PATENT DOCUMENTS

| | | | |
|---|---|---|---|
| CN | 102216547 | A | 10/2011 |
| DE | 10144791 | A1 | 3/2003 |
| DE | 102015110089 | A1 | 12/2015 |
| DE | 102014117454 | A1 | 6/2016 |
| EP | 0334253 | A11 | 9/1989 |
| JP | H1035536 | A | 2/1998 |

* cited by examiner

FLAP ASSEMBLY FOR A VEHICLE

CROSS REFERENCE TO RELATED APPLICATIONS

The present application claims priority of DE 10 2017 131 058.4, filed Dec. 22, 2017, the priority of this application is hereby claimed and this application is incorporated herein by reference.

BACKGROUND OF THE INVENTION

The invention relates to a flap assembly for a vehicle, having a flap which that is pivotably drivable by a linear actuator drive about a pivot axis counter to the gravity of the flap from a closed position to an opened position, and a spring assembly that acts in a supporting manner on the flap. The actuator drive has a housing with one end articulated on a component of the body of the vehicle. An actuator rod extends from the other end of the housing, with an external end of the actuator rod being articulated on the flap at a radial spacing from the pivot axis.

In the case of flap assemblies of this type for a vehicle it is known that the spring assembly acts across the entire stroke of the flap. This is indeed supportive in the case of the opening stroke. However, the force of the spring assembly has to be additionally overcome during the closing stroke.

BRIEF SUMMARY OF THE INVENTION

An object of the invention to provide a flap assembly of the type mentioned at the outset for a vehicle, which by way of a simple construction, avoids any additional force to be overcome in during the closing stroke of the flap.

The object is achieved according to the invention in that a spring assembly is releasably disposed on the flap-side end region of the housing of the actuator drive and includes a compression spring with a first end supported on the housing and a second end that acts on the flap at an initial opening angle of the flap <10° and, in the closed position of the flap, is held so as to be pretensioned by the flap.

The actuator drive is, for example, a spindle drive or a hydraulic or pneumatic piston/cylinder unit.

In the case of this configuration, supporting the opening stroke is performed only at the beginning of the opening stroke, when an additional support is required. The effort in terms of force required in the further course after the opening stroke is substantially lower and does not require any further support. An additional resistance to be overcome is present only at the end of the closing stroke. However, the latter also acts as a protective function in relation to an excessive powerful, undamped mechanical impact of the flap in the closed position.

The releasable disposal of the spring assembly that forms a separate functional group on the housing enables the same actuator drive to be used both with as well as without the spring assembly, as well as already existing actuator drives to be retrofitted with a spring device. A defective spring device can also be readily replaced while retaining the actuator drive.

Furthermore, one and the same actuator drive can be provided with dissimilar spring devices which can differ, for example, in terms of the force of the compression spring and/or the initial opening angle.

On account of the simple and robust construction of the spring assembly the latter is largely maintenance-free, operates largely without noise, and by virtue of the simple components thereof can be produced in a cost-effective manner.

When all elements of the spring assembly have passage openings which are coaxial with the actuator rod and through which the actuator rod protrudes, the spring assembly is disposed in an installation-space-saving manner so as to be symmetrical on the housing of the actuator drive.

In order to avoid wear on account of friction of the compression spring on the flap, the compression spring acts on the flap by way of a compression element according to an embodiment of the invention.

In a simple and cost-effective embodiment the compression spring is a coil compression spring.

According to another embodiment of the invention, the spring assembly has a sleeve-type spring housing with end region that faces the housing, the sleeve-type spring housing being disposable on the housing of the actuator drive and having an annular-disk-type support wall which is capable of being supported on the housing of the actuator drive and on which the compression spring, by way of the end thereof that faces the housing of the actuator drive, bears. A spring assembly according to this embodiment is simple to dispose in the correct installed position.

In order for the compression spring to be protected from external influences, the spring housing can have a guide sleeve which in a coaxial manner extends from the support wall away from the housing, and in which the compression spring is disposed.

The initial opening angle of the flap is determined in a simple manner when the compression element is disposed so as to be displaceable in the guide sleeve, wherein the guide sleeve has a detent that delimits the maximum stroke of the compression element.

A simple plug-fit assembly is possible on account of the end region of the spring housing that faces the housing being capable of being plug-fitted onto the flap-side end of the housing that has the same cross section.

In order for the spring assembly to be fixed to the housing of the actuator drive in a simple manner, an end region of the sleeve-type spring housing that faces the housing is capable of being fixed in a form-fitting and/or force-fitting manner in the plug-fitted position of said end region to the flap-side end of the housing. No tools are thus required for fixing.

BRIEF DESCRIPTION OF THE DRAWINGS

An exemplary embodiment of the invention is illustrated in the drawing and will be explained in more detail hereunder. In the drawing.

DETAILED DESCRIPTION OF THE PREFERRED EMBODIMENTS

Figure 1:
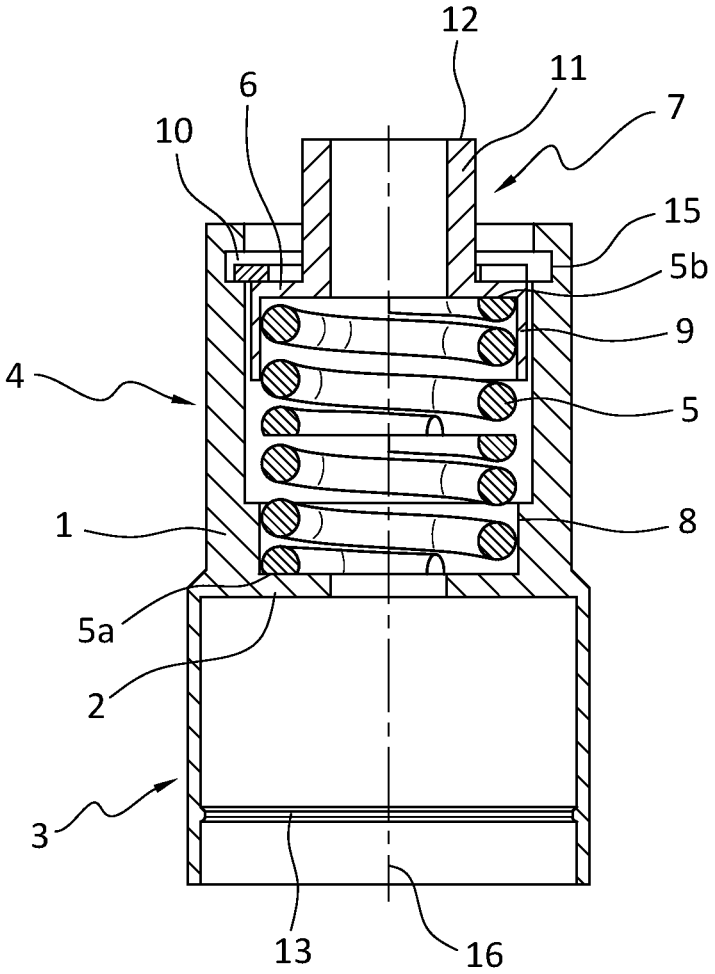
FIG. 1 is a longitudinal sectional view of a spring assembly of a flap assembly for a vehicle according to an embodiment of the invention.
Figure 2:
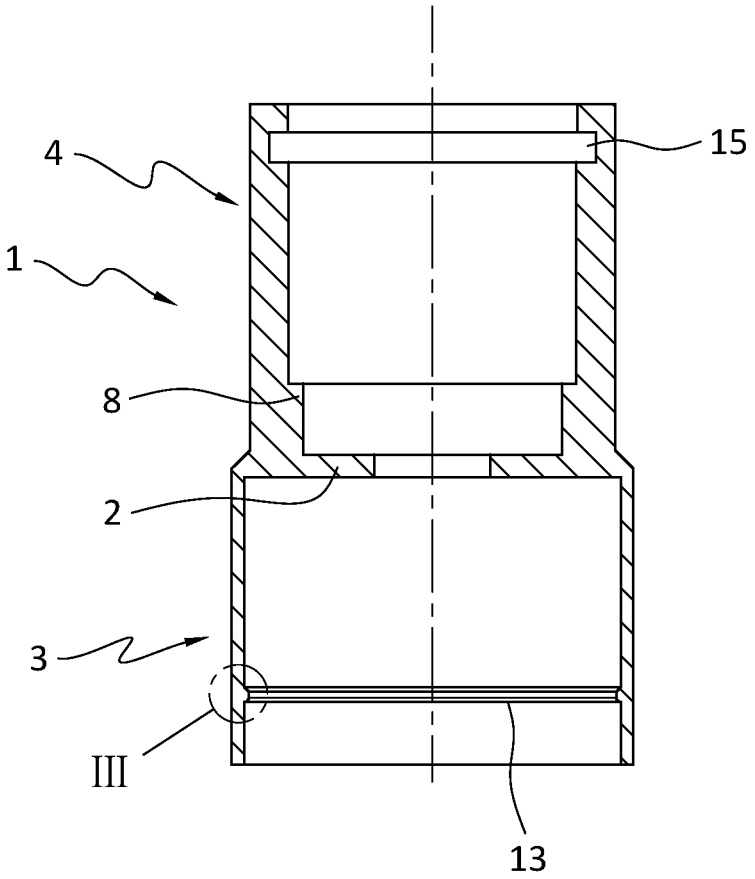
FIG. 2 is a longitudinal sectional view of a spring housing of the spring assembly of FIG. 1.
Figure 3:
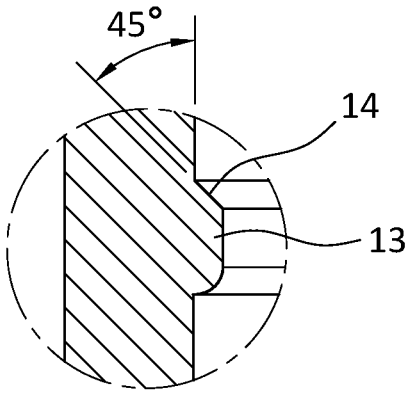
FIG. 3 shows an enlarged section III from FIG. 2.

A spring assembly illustrated in FIGS. 1-3 has a sleeve-type spring housing 1, which is preferably composed from a plastic material. An interior of the spring housing 1 in an approximately centric manner is subdivided by a disk-type support wall 2 which extends orthogonally to a longitudinal axis 16 of the spring housing 1.

Figure 4:
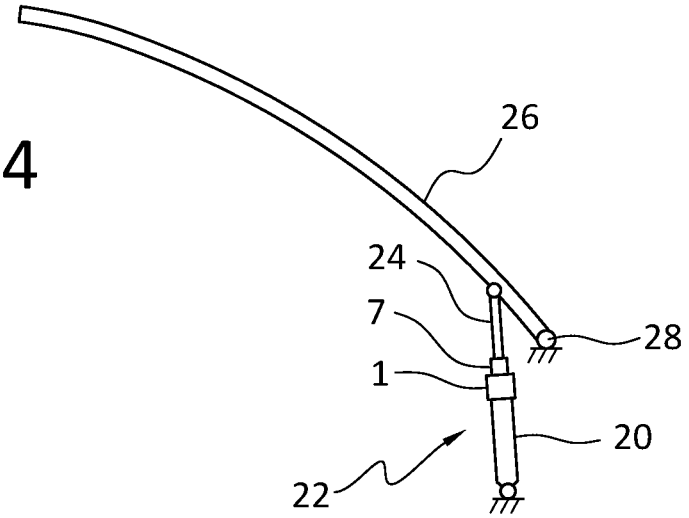
FIG. 4 is a schematic view of a flap assembly of a vehicle according to an embodiment of the invention in an opened position.
Figure 5:
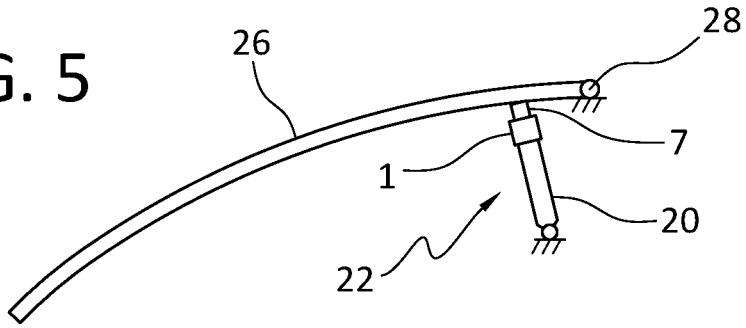
FIG. 5 is a schematic view of the flap assembly of FIG. 4 in an initial opening angle position.
Figure 6:
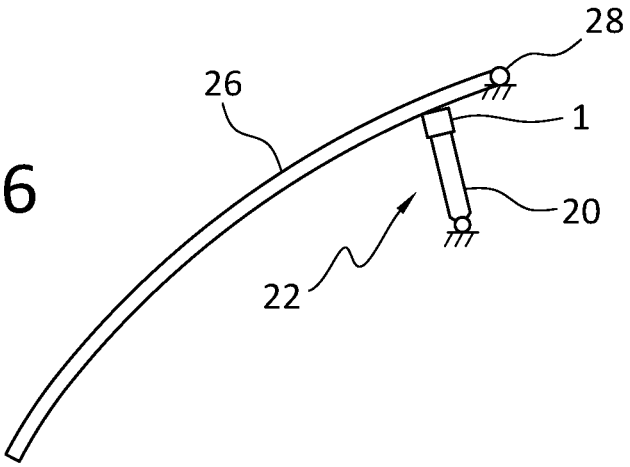
FIG. 6 is a schematic view of the flap assembly of FIG. 4 in a closed position.

An end region 3 of the spring housing 1 faces an actuator housing 20 of an actuator drive 22 (the actuator drive is shown in FIGS. 4-6) and has a cross section which corresponds to the cross section of the flap-side end region of the actuator housing 20 such that the spring housing 1 by way of the end region 3 thereof is capable of being plug-fitted onto the flap-side end region of the actuator housing 20.

In order for the spring housing 1 to be fixed to the flap-side end region of the housing of the actuator drive, the end region 3 on the internal side thereof has a radially encircling latching appendage 13 which in the installed position of the spring housing 1 latches into a corresponding radially encircling latching groove on the flap-side end region of the actuator housing 20. The spring assembly is thus held in a form-fitting and force-fitting manner on the flap-side end region of the actuator housing 20.

As can be seen in particular in FIG. 3, that sidewall 14 of the latching appendage 13 that is closer to the support wall 2 is inclined so as to be increasingly spaced apart from the support wall 2 in a radial manner from the outside toward the inside such that a disassembly of the spring assembly from the housing of the actuator drive is facilitated.

The spring housing 1 has a guide sleeve 4 which, from the support wall 2, extends counter to the end region 3, a pretensioned coil compression spring 5 being disposed in said guide sleeve 4.

One end 5*a* of the coil compression spring 5 bears on the support wall 2, and another opposing end 5*b* of the spring 5 bears on a radial widening (flange portion) 6 of a sleeve-type compression element 7.

The end 5*a* of the coil compression spring 5 that faces the end region 3 is guided in a step 8 of a reduced diameter of the guide sleeve 4, the step 8 having a diameter that is approximately identical to that of the coil compression spring 5.

The compression element 7 has a sleeve-type receptacle 9 which is directed so as to be coaxial with the support wall 2 and in which the other end 5*b* of the coil compression spring 5 is guided.

The radial widening 6 by way of the coil compression spring 5 is impinged with a force counter to a detent which is formed by a securing ring 10 inserted into an annular groove 15 that is configured so as to radially encircle the internal wall of the guide sleeve 4.

FIGS. 4-6 show a flap assembly of a vehicle including a flap 26 with the actuator drive 22 and the spring assembly of FIGS. 1-3 in an opened position, an initial opening angle position, and in the closed position, respectively. The flap 26 pivots about a pivot axis 28 on a body of the vehicle (the body of the vehicle is not illustrated). As shown in FIG. 4, the actuator drive 22 includes the actuator housing 20 and an actuator rod 24 that extends and is deployable from the actuator housing 20. An external end of the actuator rod 24 is articulated on the flap 26. One end of the actuator housing 20 is articulated on the body of the vehicle.

As the flap 26 moves from the opened position shown in FIG. 4 to the initial opening angle position shown in FIG. 5, the flap 26 comes to bear on the free end of the compression element 7, which by way of the sleeve-type region 11 thereof protrudes from the guide sleeve 4, when the flap 26 reaches the initial opening angle position. When the flap 26 is further moved from the initial opening angle position in FIG. 5 to the closed position shown in FIG. 6, the compression element 7 is displaced while compressing the coil compression spring 5 into the guide sleeve 4 until the flap 26 comes to bear on the opening periphery of the guide sleeve 4. This displacement path of the compression element 7 corresponds to a pivoting angle of <10° of the flap 26. Accordingly, the flap 26 is supported by the spring assembly when the flap 26 is opened from the closed position to the initial opening angle position.

LIST OF REFERENCE SIGNS

1 Spring housing
2 Support wall
3 End region
4 Guide sleeve
5 Coil compression spring
6 Radial widening
7 Compression element
8 Step
9 Receptacle
10 Securing ring
11 Sleeve-type region
12 Opening periphery
13 Latching appendage
14 Side wall
15 Annular groove
16 Longitudinal axis
20 Actuator housing
22 Actuator drive
24 Actuator rod
26 Flap
28 Pivot axis

What is claimed is:

1. A flap assembly for a vehicle, comprising:

a linear actuator drive having an actuator housing with a first housing end articulated on a component of a body of the vehicle and having an actuator rod extending through a second housing end of the actuator housing and movable into and out of the housing, the second housing end opposing the first housing end;

a flap pivotably drivable about a pivot axis from a closed position to an opened position by said linear actuator drive, wherein an external end of the actuator rod is articulated on the flap at a radial spacing from said pivot axis; and a spring assembly releasably disposed on the actuator housing at the second housing end of the actuator housing, the spring assembly having a compression spring with a first end and a second end, the first end of the compression spring is supported by the second housing end of the actuator housing, the second end of the compression spring acts on the flap when the flap is between the closed position and an initial opening angle of the flap of less than 10° from the closed position, and the second end of the compression spring does not act on the flap when the flap is between the initial opening angle and the opened position, the compression spring being compressed by the flap when the flap is in the closed position, wherein the spring assembly further includes a sleeve-shaped spring housing and a compression element, the spring housing having an end region disposable on the second housing end of the actuator housing, the compression element being arranged between the compression spring and the flap and being displaceable in the spring housing; and the spring housing and the compression element have respective passage openings which are coaxial with the actuator rod and through which the actuator rod protrudes, and the actuator rod being axially displaceable relative to the compression element.

2. The flap assembly according to claim 1, wherein the compression spring acts on the flap by way of the compression element.

3. The flap assembly according to claim 1, wherein the compression spring is a coil compression spring.

4. The flap assembly according to claim 1, wherein the end region of the spring housing has an annular-disk-shaped support wall capable of being supported by the second housing end of the actuator housing of the actuator drive and on which the first end of the compression spring bears.

5. The flap assembly according to claim 4, wherein the spring housing has a guide sleeve which extends from the support wall away from the actuator housing, and in which the compression spring is disposed.

6. The flap assembly according to claim 5, wherein the compression element is axially displaceable in the guide sleeve, and the guide sleeve has a detent that delimits a maximum stroke of the compression element.

7. The flap assembly according to claim 6, wherein the detent comprises a securing ring disposed in an annular groove in an internal wall of the guide sleeve.

8. The flap assembly according to claim 6, wherein the compression element includes a flange portion that interacts with the detent to delimit the maximum stroke of the compression element.

9. The flap assembly according to claim 4, wherein the end region of the spring housing is capable of being fitted onto the second housing end of the actuator housing.

10. The flap assembly according to claim 9, wherein the end region of the spring housing is capable of being fixed in one of a form-fitting manner and force-fitting manner to the second housing end of the actuator housing.

11. The flap assembly according to claim 1, wherein the actuator rod is displaceable relative to the first end and the second end of the compression spring.

12. The flap assembly according to claim 1, wherein the actuator rod is displaced relative to the compression element at least as the flap is moved between the initial opening angle of the flap and the opened position.

* * * * *